United States Patent [19]

Coppola

[11] Patent Number: 4,814,753

[45] Date of Patent: Mar. 21, 1989

[54] ATTITUDE DETECTION DEVICE

[75] Inventor: Mario Coppola, Latina, Italy

[73] Assignee: Delta Elettronica s.r.l., Varese, Italy

[21] Appl. No.: 717,324

[22] Filed: Mar. 29, 1985

[30] Foreign Application Priority Data

Apr. 3, 1984 [IT] Italy ..... 16902 A/84

[51] Int. Cl.[4] ..... G08B 21/00

[52] U.S. Cl. ..... 340/686; 340/429; 200/61.52; 310/329

[58] Field of Search ..... 340/686, 689, 665, 63–65, 340/960; 310/318, 314, 330, 338, 329, 344, 348, 315, 316; 73/1 E, DIG. 4; 200/61.45 R, 61.46, 61.49, 61.52

[56] References Cited

U.S. PATENT DOCUMENTS

| | | | |
|---|---|---|---|
| 2,552,722 | 5/1951 | King | 33/DIG. 5 X |
| 3,186,237 | 6/1965 | Forrest | 310/329 X |
| 3,488,530 | 1/1970 | Staudte | 310/348 |
| 3,498,118 | 12/1966 | Ruge | 73/766 |
| 3,750,127 | 7/1973 | Ayers et al. | 340/665 |
| 4,064,744 | 12/1977 | Kistler | 73/766 |
| 4,193,010 | 3/1980 | Kompanek | 310/330 |
| 4,327,359 | 4/1982 | Kurtz | 340/665 X |
| 4,358,750 | 11/1982 | Webster | 340/65 |
| 4,359,717 | 11/1982 | Huber et al. | 340/63 |
| 4,378,693 | 4/1983 | Ratcliffe | 340/689 X |
| 4,409,548 | 10/1983 | Focht | 73/DIG. 4 X |
| 4,459,579 | 7/1984 | David et al. | 340/960 X |
| 4,561,299 | 12/1985 | Orlando et al. | 73/517 R X |

FOREIGN PATENT DOCUMENTS

| | | | |
|---|---|---|---|
| 0158718 | 12/1980 | Japan | 310/315 |

*Primary Examiner*—Joseph A. Orsino
*Assistant Examiner*—Jeffery A. Hofsass
*Attorney, Agent, or Firm*—Peter K. Kontler

[57] ABSTRACT

A multi-element piezo-electric transducer is mounted on the wall or frame of a body and is held in a predetermined position relative to the body. The support element of the transducer is subjected to an altering force by the force applying element of the transducer which applied such force when the attitude of the body changes. The altering force is transmitted to the piezo-electric element of the transducer by way of the support element. The altering force bends or otherwise deforms the piezo-electric element thereby introducing internal stresses into the piezo-electric element which thereupon generates a detectable signal. The signal is amplified and filtered to remove frequencies in the vibration range and to provide an output signal which is proportional to the extent of change in attitude of the body. The output signal of the amplifier is applied to a trigger circuit which operates an alarm.

29 Claims, 2 Drawing Sheets

ATTITUDE DETECTION DEVICE

BACKGROUND OF THE INVENTION (1) Field of the invention

The present invention relates to detection or warning devices for detecting and providing indication of changes in attitude or inclination of a body or mass, however slowly such change in attitude or angle of inclination may occur. In particular, the invention includes a piezo-electric device which is attached to a body or mass and actuated when the attitude or inclination of the body changes.

In the process of removing wheels and/or tires from a motor vehicle, whether authorized or not, it is usual to lift one side or one end of the vehicle, as opposed to lifting the whole vehicle. In the process of lifting or raising one side or one end of a vehicle the attitude or angle of inclination of the vehicle changes. This change in attitude is viewed as a relatively slow change. As an antitheft system, the present invention responds to a change in attitude such as described above and, if a change in attitude is created by an unauthorized lifting of a part of the vehicle, an alarm would warn the owner that his vehicle is being attended, and if unauthorized, is in all probability having an act of theft committed upon it.

(2) Prior Art

In the past, warning and/or detection devices using piezo-electric devices or transducers were limited to the detection of vibrations of the body or mass to which the transducer is attached or the detection of breakage or removal of the transducer from the body.

SUMMARY OF THE INVENTION

The present invention teaches the use of piezo-electric matter in a novel structure and provides a novel piezo-electric transducer which reacts characteristically to slowly changing movement or motion heretofore considered undetectable by piezo-electric devices. A piezo-electric transducer constructed and used in accordance with the teachings herein, provides an inexpensive and reliable attitude change detector for use in an antitheft system for motor vehicles.

A piezo-electric transducer constructed in accordance with the present invention is a multi-element device. The multi-element piezo-electric device includes a piezo-electric material element having predetermined shape; a flexible support element having substantially the same predetermined shape as the piezo-electric element but somewhat larger than such element; and, a force applying element. The piezo-electric element and the support element are combined together such as by bonding, so that any altering force applied to the support element is transferred to the piezo-electric element. The force applying element may be in the form of one or more weights integrated into or mounted on the support element or may be remote from the support element but capable of applying an altering force to the support element. For the purpose of this disclosure an altering force is considered any interacting force that temporarily distorts or changes the physical characteristics of an element of the transducer, such as by bending, for example, without causing permanent distortion of the element.

In a vehicle antitheft system, the piezo-electric element would be part of an electronic circuit for receiving signals generated by the piezo-electric element in response to changes in internal stresses of the material caused by altering the material. The electronic circuit would be capable of amplifying and/or discriminating signals so generated.

The transducer would be mounted on the vehicle in predetermined rigid relationship to the vehicle. Any change in attitude of the vehicle, such as caused by lifting one side or one end thereof, would change, comparably, the attitude of the transducer. This change in attitude would be manifested as a change in gravitational forces acting upon the weights of the force applying element which, in turn, would be applied to the support element as an altering force. The altering force applied to the support element would be transferred to the piezo-electric element as a bending force which creates internal stresses in the piezo-electric element.

DESCRIPTION OF THE INVENTION

In the embodiment described herein, the invention includes at least one piezo-electric transducer and an electronic circuit, the transducer being composed of at least one laminate of piezo-electric material and a flexible support plate. In its preferred embodiment, the piezo-electric transducer is so constructed as to include a stress drive in the form of a weight coupled to the flexible support plate of the laminated transducer, which, when in a normal attitude, maintains a balanced condition with respect to the support plate but when the transducer is in an inclined position the weight is offset from normal and employing the forces of gravity, causes the piezo-electric material to bend and/or otherwise distort thereby producing mechanical or internal stresses in the piezo-electric material and therefore differences of potential between the two faces of the piezo-electric material. The differences in potential generated by the mechanical stresses are proportional to the stresses applied, which are in turn proportional to the change in attitude of the piezo-electric transducer which follows the attitude of the body or vehicle to which it is attached. Weights may be coupled to opposite ends of the support plate, or the end of the support plate may be enlarged, as may be desired.

The transducer is preferably rigidly mounted on the body whose attitude it is intended to monitor. Mounting is accomplished in such a way so that when the body is in normal attitude the transducer is in normal position, essentially vertical with the weight or weights in dynamic balance, with respect to gravity. However, when the body changes in attitude or angle of inclination the transducer follows proportionally due to rigid attachment.

Opposite faces of the piezo-electric plate are connected to an electronic circuit so as to apply any output of the transducer to a very high input impedance amplifier circuit, filtering circuits and trigger circuit. The trigger circuit includes an adjustable threshold. Signal filtering and/or discrimination may be used in such a way as to discriminate and filter out, and therefore eliminate, piezo-electric signals caused by vibrations of the body transmitted to the transducer via the mounting arrangement. However, by selection of component values, signals from the transducer caused by relatively slow changes in attitude or inclination of the body to which the transducer is attached, may be passed on to actuate a warning or indicator device. Since the degree of attitude or inclination change is proportional to the change in mechanical stress applied to the piezo-electric plate, which is proportional to the signal output of the transducer, threshold component values may be used so that a warning output is provided when at least a predetermined change of attitude of the body or vehicle occurs.

In a preferred construction, the piezo-electric sensing device includes a flexible plate to which masses or weights are bonded at each end. The flexible plate, somewhat longer than the piezo-electric plate, is connected to one of the surfaces of the piezo-electric material thus forming a laminate. The ends of the flexible plate extend beyond the ends of the piezo-electric material for supporting the weights apart from the piezo-electric material. This structure forms the transducer which is mounted on the body of a vehicle, for example, in fixed relation to the vehicle.

When a change in attitude or angle of inclination of the vehicle occurs, the attitude of the transducer also changes causing the weights to be repositioned into an off balance position with respect to gravity. The off balance weights cause the flexible plate to bend. The body bending moments are transferred to the piezo-electric element causing consequent internal stresses. These internal stresses are exhibited characteristically by the piezo-electric element as a potential difference, a signal representing a change in attitude.

In order to avoid changes in ambient temperatures, which may cause unwanted internal stresses in the piezo-electric materials, the transducer may be suitably housed in temperature change suppressing materials. This will protect against sudden temperature changes. Long range, very slow temperature changes are not seen due to self calibration.

In another construction the transducer may include two piezo-electric material elements, each with balanced masses and connected so that internal stresses in the piezo-electric materials caused by ambient temperature changes cancel each other while internal stresses caused by action of the masses causing bending moments produce differences of potential of the same magnitude and direction and hence electric signals characteristic of change in attitude.

Although preferably the transducer is mounted in a vertical attitude when attached to the body of a vehicle, for example, with the vehicle itself in a normal, vertical attitude, the transducer, since it is self calibrating, would automatically drive itself to zero if the mounting angle should be offset slightly. I its most desirable mounted position, which is an angle of inclination of zero (0°) degrees with respect to normal, a change in the angle of inclination, either to the left or to the right, will cause progressively increasing bending moments up to ninety (90°) degrees from normal. When the angle change exceeds 90°, the bending moments will progressively decrease with increase of the angular change.

OBJECTS OF THE INVENTION

It is an object of the invention to provide a piezo-electric device for detecting relatively slow changes in attitude.

Another object of the invention is to provide an attitude change detection device which employs a piezo-electric device which is insensitive to vibration.

A further object of the invention is to provide an attitude change detection device which is self calibrating and self cancelling with respect to changes in ambient temperature.

A further object of the invention is to provide an attitude change warning device which has no moving parts subject to wear.

DETAILED DESCRIPTION OF THE PREFERRED EMBODIMENTS

The description hereunder will be given of the preferred embodiment and alternate embodiments of the present invention with reference to the drawings. However, it will become apparent in practicing the present invention that other structures and combinations may be used which may depend on the particular use to which the invention is directed.

Figure 1:
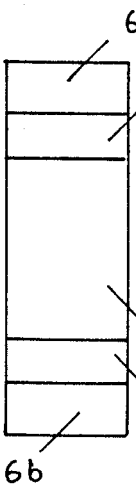
FIG. 1 is a representation, in front elevation, of a sensor element employed in the present invention.
Figure 2:
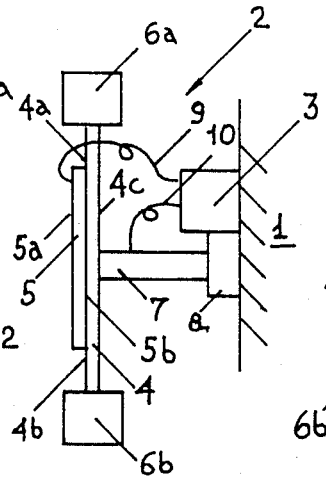
FIG. 2 is a representation in side elevational view of the detection device mounted on the wall of a body.
Figure 3:
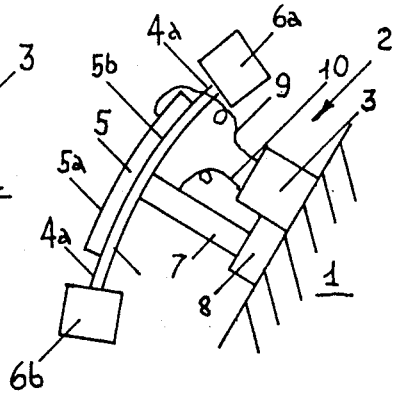
FIG. 3 represents the detection device of FIG. 2 in an inclined position.

Referring now to FIGS. 1, 2 and 3, the structure of the transducer represented in these drawings may be employed, for example, in an antitheft warning system of a motor vehicle. The piezo-electric transducer is shown at 2 and is connected to a box 3 representing the electronic circuit illustrated in circuit form in FIG. 8. The piezo-electric device includes an elongated flexible plate 4 with weights 6*a* and 6*b* attached to the ends of the plate 4. Plate 5 represents a rectangular body of piezo-electric material attached or bonded, at one of its faces or surfaces, to one of the faces of the rectangular flexible plate 4. It will be noted that the piezo-electric plate 5 is somewhat shorter than plate 4, by the width of the portions 4*a* and 4*b* to which the weights 6*a* and 6*b* are attached. This composite or laminate structure forms the piezo-electric transducer 2. Although the weights 6*a* and 6*b* are shown as apparent separate elements attached to plate 4, these could be substituted for a structure that would integrate heavy portions on to the parts 4*a* and/or 4*b* of plate 4.

The flexible plate 4 is preferably thin and has a rectangular shape. The piezo-electric plate 5 may be silver plated on opposite surfaces 5*a* and 5*b* and bonded by a suitable adhesive, preferably a flexible adhesive, to plate 4, which imparts body bending moments to the piezo-electric plate 5. A support bar 7 is attached to plate 4 on the surface opposite that to which plate 5 is bonded. The support bar 7 may be made of an insulator material or, in the alternative, the bar 7 may be fixed to an insulator base 8 which base is fixed to the wall or frame 1 of a motor vehicle. Preferably, the attachment of bar 7 to plate 4 will have minimal interference with the bending characteristics of plate 4.

Figure 6:
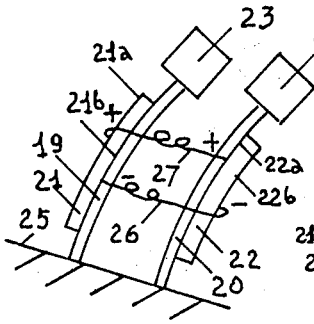
FIGS. 6 and 7 represent additional embodiments of the invention.
Figure 7:
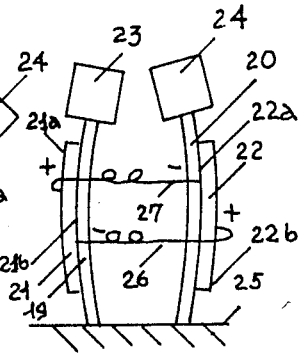

If the plate 5 is electrically isolated from the plate 4, electric conductors may be connected to the opposite silver plated surfaces 5*a* and 5*b* of the plate 5. This type of electrical connection is represented in FIGS. 6 and 7. However, in FIGS. 2 and 3 it is assumed that the plates 4 and 5 are electrically connected and that support 7 is electrically connected to surface 4c of the plate 4. Thus, a conductor 9, such as a thin copper wire, for example, is coupled to the surface 5a of plate 5 and a second conductor 10 is coupled to the support bar 7. The conductors 9 and 10 are connected to the electronic circuit represented by box 3. The support bar 7 is electrically isolated from body 1 by isolation block 8.

The transducer 2 is fixed on the wall or frame 1 of the vehicle with the long dimension of the plate 4 upright in such a way that the two masses or weights 6a and 6b are at balance in a vertical plane. In these conditions the plate 4 will not undergo any bending moments. When a change in attitude or inclination of the vehicle occurs, the plate 4 will follow the attitude of the vehicle and will rotate around the horizontal axis clockwise or counterclockwise. The weights 6a and 6b will become offset from normal and by the force of gravity, will cause the plate 4 to bend with a force proportional to the magnitude of change, up to an angle of 90°. This bending movement of plate 4 will be imparted to the piezo-electric plate 5, which will bend to essentially the same magnitude as plate 4. The bending of these plates is referred to as alteration. The piezo-electric plate 5 will develop a difference of potential proportional to the extent of bending. The polarity of the potential will depend on the direction (clockwise or counter clockwise) of bending. It can therefore be seen that the magnitude of potential difference and the polarity of such difference are a function of the magnitude and direction of the change in attitude or inclination of the vehicle to which the transducer is attached.

Figure 4:
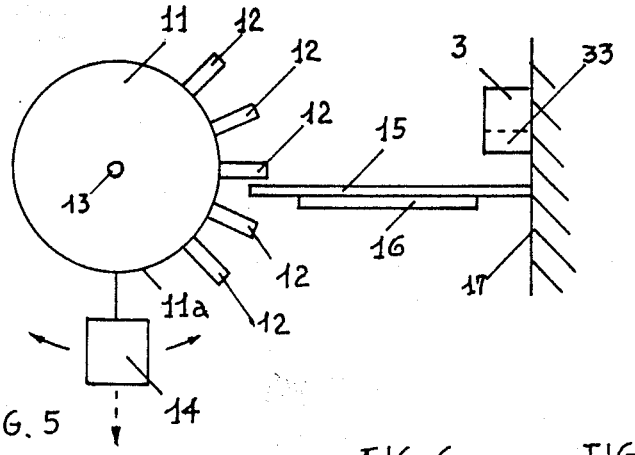
FIG. 4 represents an alternative embodiment of the invention.

FIG. 4 represents an alternate structure of the invention where the transducer includes a rotatable wheel 11, with radial spokes 12 extending from circumference 11a of the wheel, at uniform angular distances. The wheel 11 is idly mounted on the central shaft 13 which is mounted in journal boxes (not shown) fixed to the frame or body of the motor vehicle. On the lower external part of the wheel there is mounted a mass or weight 14 of such magnitude as to keep the wheel in the same position relative to the vertical when the attitude or inclination of the vehicle changes and thus the attitude of the mounting shaft at 13. The wheel 11 will rotate with the shaft 13 as the shaft 13 follows the attitude of the vehicle to which it is attached.

The plate 15 represents the flexible, supporting plate, such as 4 in FIGS. 1, 2 and 3 while the plate 16 represents the piezo-electric material element, such as 5 in FIG. 1, 2 and 3. The plate 15 is supported at one end in a substantially horizontal position in the frame or wall at 17. As is evident from the drawings, the radial extensions 12 extend beyond the nearer end of the plate 15 toward the opposite end and as the attitude of the vehicle changes, thus changing the angular position of the shaft 13 supporting the wheel 11, the weight 14 will cause the wheel 11 to rotate with the shaft 13 with respect to the frame of the vehicle and also with respect to the combined piezo-electric plate 16 and flexible support plate 15. As the wheel rotates by virtue of the weight 14 tending to hold its vertical position, a spoke 12 will impinge upon and bend the plate 15.

In this structure the bending moments applied to the plates 15 and 16 will be intermittent and the magnitude of change will be a function of the number of impulses generated by the piezo-electric element bending and retreating to normal, as the spokes 12 continue to turn. In this structure the electronic circuit 3 will include a pulse counter 33 in addition to the amplifier, filter and switching circuits.

Figure 5:
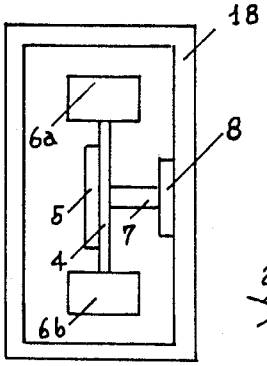
FIG. 5 represents the detection device protected against environmental change.

FIG. 5 represents the transducer of Figs. 1, 2 and 3 in a case 18 which protects the transducer elements from rapid changes of ambient temperature which normally produce internal tensions in the piezo-electric material and as a consequence a potential difference between the faces of the plate 5. Normal temperature changes are very slow and in the R-C networks of the electronic circuit are self-compensating.

FIGS. 6 and 7 represent a dual composite transducer which includes dual support plates 19 and 20 with attached piezo-electric material plates 21 and 22. These dual composite elements are mirror images of each other with each support plate 19 and 20 carrying a weight or mass 23 and 24 respectively at its upper end while the lower end of each support plate is fixed to the frame or body 25 of the motor vehicle.

In this structure, the opposite faces 21a and 22a as well as 21b and 22b are connected to each other via respective conductors 27 and 26 so that when the dual composite transducer is subjected to a temperature change, the coupled plates of the dual composite transducer will bend toward each other. This is shown in FIG. 7 and, as a result, the tensions generated in the piezo-electric plates 21 and 22 will be substantially equal and opposite and therefore the potential differences so generated will act to cancel each other. This feature serves to cancel out the temperature effect on the piezo-electric material in the transducer.

However, as seen in FIG. 6, when the dual element transducer is subjected to a change in attitude the weights 23 and 24 will serve to impart corresponding bending moments to the plates 21 and 22 via plates 20 and 19.

In order to achieve higher sensitivity to a change in attitude, as well as to detect forward and reverse movements of the vehicle, a second transducer may be positioned in a plane normal to the plane of the first transducer. In such configuration an attitude or inclination detection system would be sensitive to a lifting of the vehicle from one side, while pivoting on the other side, as well as sensing an attitude change originating in the front of the vehicle or the rear of the vehicle, i.e., lifting from the front or lifting from the rear.

The latter construction, i.e., a construction that is sensitive to changes in attitude along the longitudinal axis of the vehicle, may also be used to detect changes in acceleration and deceleration of the vehicle, while in motion.

Figure 8:
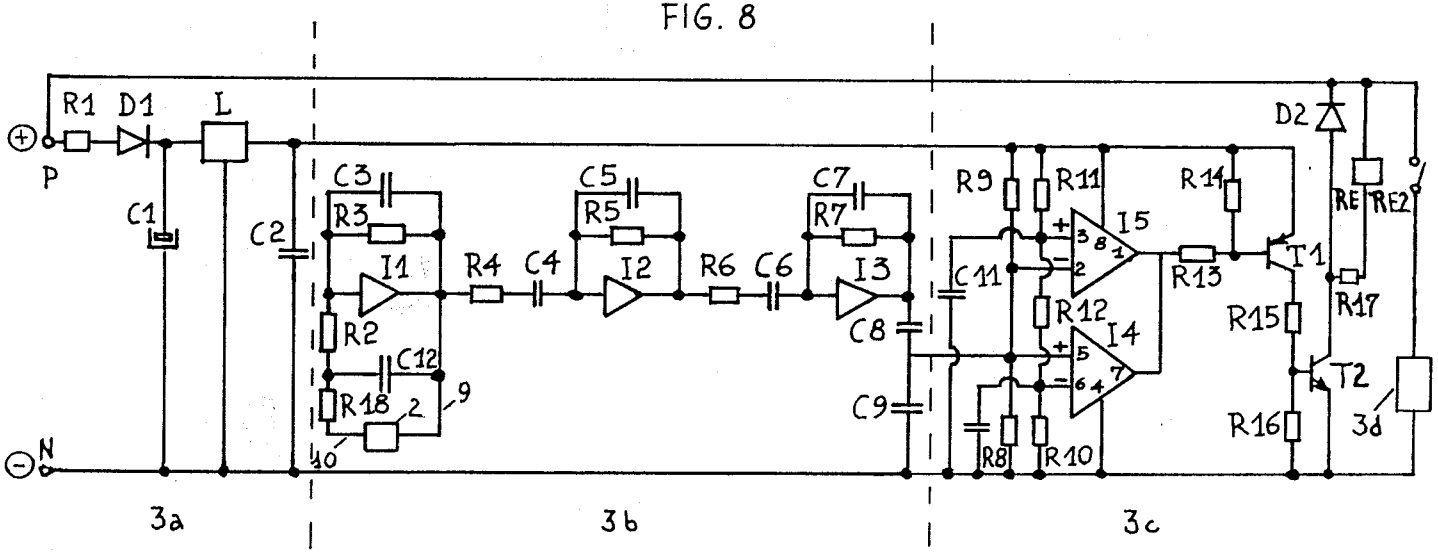
FIG. 8 is a circuit diagram of the electronic circuit of the invention.

Referring now to FIG. 8, the electronic circuit 3 comprises three sections. Section 3a comprises a power supply which may, when used on a motor vehicle be connected to the positive, P and negative, N terminals of the battery providing electric power for the vehicle. Section 3b includes a very high input impedance triple stage amplifier, and section 3c comprises a trigger circuit which actuates an alarm 3d in response to energization of a relay RE which closes normally open contacts RE 2.

The power supply 3a which includes the battery of the vehicle, represented by terminals P and N comprises a protection diode D1 (4004), resistor R1 (100Ω) and electrolytic filter condenser C1 (1000 μF). A stabilizer L (7805 National) and a condenser C2 (100KpF) are also provided to ensure a ripple free supply.

Th triple-stage amplifier 3b such as provided on integrated element CD 4007 includes the three stages I1, I2 and I3, each stage being connected to a condenser respective C3 (220KpF), C5 (100KpF) and C7 (100KpF) and a feedback resistor respectively R3 (100MΩ), R5 (100MΩ) and R7 (100MΩ). The input of the second stage I2 is connected to the output of the first stage I1 through the coupling group resistor R4 (330KΩ) and capacitor C4 (10uf). The input of the third stage amplifier I3 is connected to the output of the second stage I2 through the coupling group resistor R6 (330KΩ) and capacitor C6 (10MF). The input of the amplifier circuit 3*b* is connected to a pin of the first stage I1 and the output of the amplifier 3*b* is connected to two pins of the third stage I3. The second and third amplification stages are each connected to the supply and return, as will be familiar to, those in the art, and these connections are not shown in the diagram.

The trigger circuit 3*c* includes a dual comparator LM393 which is formed by two comparator circuits I4 and I5. The input of the dual comparator is coupled to the output of the amplifier 3*b* through coupling capacitor C8 (10 μF) and filter condenser C9 (100KpF). Each of the comparator circuits I4 and I5 is provided with a filtering condenser (100KpF) as at C11 for the circuit 15, a polarizing resistor, respectively R8 and R9 (4.7 MΩ each), a threshold resistor, respectively R10 and R11 (4.7MΩ each) and, between them, the resistor R12 (1kΩ) for fixing the respective threshold values of each of the two comparator circuits.

The pin connections of the two comparator circuits I4 and I5, and the connections to positive power and return are shown in FIG. 8 since these connections are distinguished from those of the amplifier. The output of the dual comparator, which consists of two pins, is connected to the base of transistor T1 (PNP/BC212B) through a change resistor R13 (3.3KΩ). The base of T1 is connected to the positive supply through polarizing resistor R14 (2.2KΩ). The collector of the transistor T1 is connected directly to the positive supply while the emitter is connected to the base of a transistor T2 (NPN/PN2222) through a charge resistor R15 (1KΩ), which base is connected to the return through polarizing resistor R16 (1KΩ).

The output of the trigger circuit represents the output of the electronic circuit 3 and corresponds to the condition of transistor T2. When transistor T2 turns "on", the relay RE is energized by the power supply, through a coil of RE, and through a circuit including a resistor R17 (100Ω) and the emitter/collector circuit of the transistor T2 to the return. Energization of relay RE results in closing of the normally open contact RE2 and in completion of the alarm circuit which energizes the alarm 3*d*. The alarm 3*d* may be audible or an illuminated indication or both. The alarm 3*d* could initiate another signal, such as a radio call, for example. The collector circuit of transistor T2 includes a protection diode D2 (4004).

When the transducer 2 generates a difference of potential, the change in potential across the transducer functions to change capacitor C12 (2 μF) through resistor R18 (10MΩ). The time constant of this R-C charging circuit determines the time of return of the system to zero. After capacitor C12 is discharged through resistor R2 (10MΩ), the system is ready to detect a further change in attitude of the vehicle.

The signal generated in response to alteration of the transducer piezo-electric element is progressively amplified and filtered through the amplifier circuit 3*b*. The amplified, filtered signal is applied to the trigger circuit 3*c* which further discriminates the signal. By selecting the values of resistors R8, R9, R10, R11 and R12 the threshold of the trigger circuit can be adjusted so that the trigger will respond to at least a particular, predetermined change in angle of inclination of the vehicle to which the detection system is attached. Upon overcoming the threshold value, the trigger circuit 3*c* will operate to energize the relay RE, as previously described.

In the event that a detection system should employ a transducer such as shown in FIG. 4, and a pulse counter, as represented by 33 is employed, the pulse counter may be substituted for the trigger circuit and the pulse count overflow level, before energizing a relay for operating an alarm circuit, may serve as the threshold.

As will be seen, changes in the electrical properties of the piezo-electric materials, no matter how slow in their progression, will be detected and amplifier. Filtering may be accomplished as a function of frequency so that signals from the piezo-electric element generated in response to vibrations may be filtered out and signals very low in frequency (essentially a pulse, timed in parts of a second to several seconds) to a continued pulse signal may be passed to the trigger circuit for further processing.

I claim:

1. A system for detecting a change in the inclination of a body, comprising piezoelectric transducer means including at least one piezoelectric member for generating a signal in response to internal stress, said piezoelectric transducer means comprising at least one piezoelectric transducer including said one member and a flexible second member which is coupled to and supports said one member; stressing means for stressing said one member in response to changes in the inclination of the body, said stressing means being arranged to act on said second member; means for mounting said second member on the body; and circuit means for processing signals generated by said one member, said circuit means being designed to store and maintain a signal generated by said one member to thereby permit detection of gradual changes in the inclination of the body.

2. The device of claim 1, wherein said mounting means is arranged to hold said piezo-electric transducer in a substantially vertical position and said stressing means includes at least one weight coupled to one end of said second member.

3. The device of claim 1, wherein said mounting means includes a mounting arm attached to said body and to said second member for suspending said transducer in an essentially vertical position lengthwise and said stressing means includes a first mass coupled to one end of said second member and a second mass coupled to the opposite end of said second member.

4. The device of claim 1, wherein said second member is mounted on the body by securing one end of said second member to the body and said transducer is held in a substantially vertical position lengthwise, said stressing means including a weight coupled to said second member.

5. The device of claim 1, further comprising means for substantially enclosing said piezo-electric transducer for isolating the latter from rapid changes in temperature.

6. The system of claim 1, wherein said circuit means comprises an amplifier circuit having a very high input impedance, said amplifier circuit being coupled to said one member so as to receive a signal generated thereby and to produce an amplified output signal, and said circuit means further comprising a trigger circuit coupled to said amplifier circuit for receiving said output signal and having first and second states, said trigger circuit including at least one threshold element for changing the state of said trigger circuit when the magnitude of said output signal reaches a predetermined value, and said circuit means also comprising a device operable to perform a specified function in response to a change of state of said trigger circuit.

7. The system of claim 6, wherein said mounting means includes an arm coupled at its one end to the body and coupled at its other end to the second member of said piezo-electric transducer for rigidly supporting said transducer on the body and in a substantially vertical position, said stressing means including at least one weight coupled to one end of said second member for appying to said second member a bending force for altering said second member when said transducer is moved from said vertical position by a change in attitude of the body.

8. The system of claim 6, wherein said mounting means includes means for rigidly coupling an end of said second member to the body for supporting said transducer in a substantially vertical position, said stressing means including a weight which is coupled to the other end of said second member, said weight being arranged to apply to said second member a bending force for altering said second member when said transducer is moved from said vertical position by a change in attitude of the body.

9. The system of claim 6, said circuit means comprising filter means for filtering out signals generated by said one member in response to internal stresses generated by vibration of said second member.

10. The system of claim 6, wherein said mounting means is arranged to rigidly couple one end of said transducer to the body and said transducer is normally located in a substantially horizontal plane.

11. The system of claim 1, wherein said circuit means comprises an RC circuit for storing and maintaining a signal generated by said one member.

12. The system of claim 1, wherein said circuit means comprises an amplifier circuit having a very high input impedance.

13. The system of claim 1, wherein said circuit means comprises a device designed to perform a specified function in response to a signal generated by said one member upon a change in the inclination of the body.

14. The system of claim 13, wherein said device comprises an alarm.

15. The system of claim 13, wherein said circuit means comprises a trigger circuit designed to actuate said device in response to a signal having at least a predetermined threshold value.

16. The system of claim 15, wherein said circuit means comprises at least one adjusting element for adjusting said threshold value.

17. The system of claim 1, wherein said circuit means comprises at least one filter element for filtering out signals due to vibrations of said one member.

18. The system of claim 1, wherein said one member is plate-like.

19. The system of claim 1, wherein said stressing means comprises at least one weight.

20. The system of claim 19, wherein said one weight is coupled to said one member.

21. The system of claim 1, wherein said stresssing means is arranged to cause bending of said one member in response to a change in inclination.

22. A system for detecting a change in the inclination of a body, comprising piezo-electric transducer means including at least one piezo-electric member for generating a signal in response to internal stress, said transducer means comprising at least one piezo-electric transducer including said one member, and a flexible second member which is coupled to and supports said one member, said second member being elongated; means for mounting said second member on the body, said mounting means being arranged to couple said second member to the body in a substantially horizontal position; stressing means for stressing said one member in response to changes in the inclination of the body, said stressing means being arranged to act on said second member, and said stressing means including a rotary third member, and a shaft defining an axis for rotation of said third member and coupled to the body, said third member including a weight arranged to maintain said third member in a substantially constant position relative to the vertical so that said third member is rotated about said axis when a change in attitude of the body occurs, and said third member further comprising spoke means extending from the periphery thereof so as to come into force-applying contact with said second member during rotation of said third member; and circuit means for processing signals generated by said one member, said circuit means being designed to store and maintain a signal generated by said one member to thereby permit detection of gradual changes in the inclination of the body.

23. A system for detecting a change in the inclination of a body, comprising piezo-electric transducer means including at least one piezo-electric member for generating a signal in response to internal stress; stressing means for stressing said one member in response to changes in the inclination of the body, said stressing means being designed to apply a number of pulses to said one member; and circuit means for processing signals generated by said one member, said circuit means being designed to store and maintain a signal generated by said one member to thereby permit detection of gradual changes in the inclination of the body, and said circuit means comprising a device designed to perform a specified function in response to a signal generated by said one member upon a change in the inclination of the body, said circuit means further comprising a pulse counter designed to actuate said device when the number of pulses reaches a predetermined value.

24. A system for detecting a change in the inclination of a body, comprising piezo-electric transducer means including a pair of discrete piezo-electric transducers, each of said discrete piezo-electric transducers comprising a piezo-electric member for generating a signal in response to internal stress, and said discrete piezo-electric transducers being arranged in such a manner that stressing of said members due to temperature changes causes said members to generate respective signals of substantially identical magnitude but opposite sign while stressing of said members due to changes in inclination causes said members to generate respective signals of substantially identical magnitude and like sign; stressing means for stressing said members in response to changes in the inclination of the body; and circuit means for processing signals generated by said members, said circuit means being designed to store and maintain a signal generated by said members to thereby permit detection of gradual changes in the inclination of the body.

25. A system for detecting a change in the inclination of a body, comprising piezo-electric transducer means including a pair of discrete piezo-electric transducers, each of said discrete piezo-electric transducers comprising a piezo-electric member for generating a signal in response to internal stress, and a flexible member whihc is coupled to and supports the respective piezo-electric member, and each of said piezo-electric members having substantially the same shape as, but a size and coefficient of thermal expansion different from, the respective flexible member, said discrete piezo-electric transducers being mirror images of one another; means for mounting said flexible members on the body, said mounting means including respective mounting elements for mounting the respective flexible members on the body; stressing means for stressing said piezo-electric members in response to changes in the inclination of the body, said stressing means being arranged to act on said flexible members and including a first weight coupled to one end of each flexible member; and circuit means for processing signals generated by said piezo-electric members, said circuit means being designed to store and maintain a signal generated by said piezo-electric members to thereby permit detection of gradual changes in the inclination of the body. changes in the inclination of the body, and said circuit means including an amplifier circuit having a very high input impedance, said amplifier circuit being coupled to said one member so as to receive signals generated thereby and to produce amplified output signals, and said circuit means further including a pulse counter coupled to the output of said amplifier circuit for counting and accumulating the output signals and generating an outgoing signal when the number of output signals reaches a predetermined value, said circuit means also including a device operable to perform a specified function in response to the outgoing signals of said pulse counter.

26. The device of claim 25, wherein said mounting means rigidly supports the respective flexible members in substantially vertical positions.

27. The device of claim 26, said stressing means comprising second weights coupled to the other ends of said flexible members.

28. The device of claim 25, wherein said mounting means is arranged to couple the other end of each of said flexible members to the body.

29. A system for detecting a change in the inclination of a body, comprising piezo-electric transducer means including at least one piezo-electric member for generating a signal in response to internal stress, said transducer means comprising at least one piezo-electric transducer including said one member, and a flexible second member which is coupled to and supports said one member; means for mounting said second member on the body; stressing means for stressing said one member in response to changes in the inclination of the body, said stressing means being arranged to act on and apply pulses to said second member; and circuit means for processing signals generated by said one member, said circuit means being designed to store and maintain a signal generated by said one member to thereby permit detection of gradual changes in the inclination of the body, and said circuit means including an amplifier circuit having a very high input impedance, said amplifier circuit being coupled to said one member so as to receive signals generated thereby and to produce amplifier output signals, and said circuit means further including a pulse counter coupled to the output of said amplifier circuit for counting and accumulating the output signals and generating an outgoing signal when the number of output signals reaches a predetermined value, said circuit means also including a device operable to perform a specified function in response to the outgoing signals of said pulse counter.

* * * * *